US007331578B2

(12) United States Patent
Sano et al.

(10) Patent No.: US 7,331,578 B2
(45) Date of Patent: Feb. 19, 2008

(54) SHEET FEEDING DEVICE AND METHOD FOR DETECTING OVERLAPPING SHEETS

(75) Inventors: Kazuhide Sano, Yamanashi-ken (JP); Syunichi Hirose, Minami-alps (JP); Masashi Yamashita, Kofu (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 390 days.

(21) Appl. No.: 11/127,259

(22) Filed: May 12, 2005

(65) Prior Publication Data

US 2005/0275162 A1 Dec. 15, 2005

(30) Foreign Application Priority Data

Jun. 8, 2004 (JP) ..... 2004-170396

(51) Int. Cl.
*B65H 7/12* (2006.01)

(52) U.S. Cl. ..... 271/262; 271/263; 271/265.04

(58) Field of Classification Search ..... 271/258.01, 271/262, 263, 265.04
See application file for complete search history.

(56) References Cited

U.S. PATENT DOCUMENTS 4,066,969 A * 1/1978 Pearce et al. ..... 367/125
6,053,495 A * 4/2000 Hara et al. ..... 271/263
6,212,130 B1 4/2001 Brazeal, Jr. et al.
6,397,671 B1 * 6/2002 Nishio et al. ..... 73/159
7,130,245 B2 * 10/2006 Okitsu et al. ..... 367/125
7,172,195 B2 * 2/2007 Sano et al. ..... 271/262
2003/0006550 A1 * 1/2003 Chujo et al. ..... 271/262
2004/0100018 A1 * 5/2004 Phinney et al. ..... 271/262
2004/0150155 A1 * 8/2004 Okitsu et al. ..... 271/262

FOREIGN PATENT DOCUMENTS

JP 6-49567 12/1994
JP 2000-095390 4/2000
JP 2003-176063 6/2003

* cited by examiner

*Primary Examiner*—David H Bollinger
(74) *Attorney, Agent, or Firm*—Manabu Kanesaka

(57) ABSTRACT

A sheet feeding device includes a stacker on which sheets are placed, a sheet feeding device for separating and feeding a sheet from other sheets on the stacker, a sheet overlap sensing device placed in a sheet conveying path at a downstream side of the sheet feeding device, and a sheet sensing device for detecting whether the sheet is located in the sheet overlap sensing device. An error determining device determines whether the sheet overlap sensing device is operating normally.

6 Claims, 12 Drawing Sheets

SHEET FEEDING DEVICE AND METHOD FOR DETECTING OVERLAPPING SHEETS

BACKGROUND OF THE INVENTION AND RELATED ART STATEMENT

The present invention relates to a sheet feeding device that separates and feeds a sheet from other sheets stacked on a stacker, and a method for detecting overlapping sheets fed by the stacker.

Sheet feeding devices for printing, copying or the like are commonly used in various apparatuses such as scanner apparatuses, copying apparatuses, and printing apparatuses to separate and feed each of a bundle of sheets stacked on a stacker to a processing platen. At the processing platen, processing such as image reading or printing is executed on the sheet, and the sheet is conveyed to a sheet discharging section.

Such a sheet feeding device needs to accurately separate and feed each sheet from other sheets stacked on the stacker to a processing platen in a correct position, so that a predetermined process can be executed on the sheet. Erroneous process may result from non-feed in which no sheets are fed from the stacker or double feed in which two or more sheets overlap while being fed.

A serious processing error such as page missing may occur in a device in which sheets to be handled are a series of document sheets having a fixed page order. Thus, it is necessary to detect, for example, a sheet delivered from the stacker to the processing plate during conveyance and then suspend the processing in the platen in the case of non-feed or double feed. To detect such sheet feeding errors such as non-feed, a common method is to place, for example, a photoelectric sensor (a combination of a light emitting element and a light receiving element) in a conveying path so as to determine that a non-feed error is occurring if no sheets from the stacker reach the conveying path even a predetermined time after the start of processing or determine that a jam is occurring if a sheet remains in the conveying path even after a predetermined time has passed (time required for the largest sheet to pass). In this case, the sensor causes the device to stop and warns the user of the error.

On the other hand, to detect the double feed, a known method is to place a transmitting element and a receiving element in the conveying path and opposite each other, so that the transmitting element provides light, ultrasonic wave, or the like, while the receiving element detects this via a sheet. Comparing device such as a comparator determines whether or not overlapping sheets are occurring, depending on whether or not the light or ultrasonic wave received by the receiving element has at least a predetermined reference value. The use of a pair of ultrasonic sensors as such a device detecting overlapping sheets is disclosed in Japanese Utility Model (Kokoku) No. 6-49567, Japanese Patent Publication (Kokai) No. 2000-95390, Japanese Patent Publication (Kokai) No. 2003-176063, and the like.

In all these devices, an ultrasonic transmitting and receiving elements are arranged opposite each other across a sheet in a sheet conveying path. The receiving element detects an ultrasonic wave transmitted by the transmitting element via the passing sheet. The receiving element thus determines whether one or two or more sheets are passing on the basis of the amount of ultrasonic energy attenuated. For example, the structure shown in FIG. 2 is known as an ultrasonic sensor used to detect sheets.

Specifically, a piezoelectric vibrator made of ceramic or the like is embedded in a case made of metal or the like. A protective material such as a resin is filled in the case. A lead is connected to electrodes (deposition layer such as silver) formed on front and back surfaces of the piezoelectric vibrator. A high frequency voltage of a predetermined frequency is applied to an element used as a transmitter through its lead. An element used as a receiver then acquires an output from the transmitter through its lead according to a voltage generated in its piezoelectric vibrator. Then, a determining circuit rectifies and amplifies this potential to compare the resulting potential with a reference value to determine whether or not overlapping sheets are occurring.

During a process of manufacturing such transmitting and receiving elements, the size or shape of the piezoelectric vibrator or the shape of the metal case may vary. Consequently, the transmitting and receiving elements may have different characteristic frequencies. Even though elements having a certain allowable range of characteristics are used as a pair of transmitting and receiving elements, the characteristics may change after being incorporated into the apparatus. Similarly, if an element placed in the conveying path is shifted from its correct position, it may carry out erroneous detections, that is, it may determine one sheet, which is normal, to be overlapping sheets or overlapping sheets to be normal.

As described above, when overlapping sheets are to be detected, erroneous detections may be carried out if the characteristics of the ultrasonic element or light emitting or receiving element are changed by degradation in use or the mounting position or posture of the sheet conveying path is structurally changed by an external shock. In such a case, when the same erroneous detection occurs frequently and the user suspects that the device is defective, a maintenance operation is conventionally performed by replacing the detecting element with a new one.

However, it is difficult for the user to determine whether the device for detecting overlapping sheet is normal or defective. If overlapping sheets are erroneously detected, it is difficult to determine whether the sheet is out of standard or the device itself is defective. Accordingly, when an erroneous detection occurs frequently and the user suspects that the device is defective, a maintenance operation is normally performed by replacing the corresponding part with a new one.

In view of the problems described, a main object of the present invention is to provide a sheet feeding device comprising a structure that determines whether or not a detection is erroneous and with which the device can self-diagnose whether or not sheet overlap detecting element is normal when the device is actuated or when a job is ended, as well as a method for determining overlapping sheets.

Further objects and advantages of the invention will be apparent from the following description of the invention.

SUMMARY OF THE INVENTION

To accomplish the above objects, according to the present invention, a sheet feeding device comprises a stacker on which sheets are placed; a sheet feeding device for separating and feeding each sheet from other sheets on the stacker; a sheet overlap sensing device placed in a sheet conveying path at a downstream side of the sheet feeding device; a sheet sensing device for detecting whether the sheet is located in the sheet overlap sensing device, and an error determining device for determining whether the sheet overlap sensing device is normal.

The sheet overlap sensing device comprises a transmitting element and a receiving element arranged opposite each other across the sheet in the sheet conveying path. The error determining device determines whether the sheet overlap detection is erroneous on the basis of an output signal from the receiving element and a detection signal from the sheet sensing device. In this case, the error determining device comprises a comparing device for comparing an output value from the receiving element with an predetermined reference value. The error determining device determines that the sheet overlap detection is erroneous when the comparison by the comparing device and the detection by the sheet sensing device are such that (1) the output value from the receiving element is smaller than the reference value when the transmitting element is active and when the detection signal from the sheet sensing device indicates the absence of the sheet, or (2) the output value from the receiving element is larger than the reference value when the transmitting element is inactive.

The sheet overlap sensing device may comprise the transmitting element which transmits an ultrasonic wave and the receiving element which receives the ultrasonic wave. Further, a sheet conveying device such as rollers and belts is provided in the sheet conveying path to convey the sheets. The sheet conveying device performs control such that when the error determining device determines that the sheet overlap detection is erroneous, the sheet conveying device conveys the sheet while ignoring the detection by the sheet overlap sensing device.

The error determining device determines that the sheet overlap detection is erroneous when the amount of ultrasonic wave attenuated has at least a predetermined value while the signal from the sheet sensing signal indicates the absence of the sheet according to the difference between the amount of ultrasonic wave transmitted by the transmitting element and the amount of ultrasonic wave received by the receiving element. Alternatively, the error determining device determines that the sheet overlap detection is erroneous when the output value from the receiving element is at least at a predetermined level while the transmitting element is inactive.

According to the present invention, a method detects overlapping sheets using a sheet overlap sensing device located in a conveying path while each of sheets stacked on a stacker is fed to the conveying path. The method comprises a sheet detecting step of detecting whether there is any sheet located in the sheet overlap sensing device; a sheet overlap detecting step of detecting whether overlapping sheets are occurring using the sheet overlap sensing device; and an error determining step of determining that the sheet overlap sensing device is abnormal when the absence of the sheet is detected in the sheet detecting step and when overlapping sheets are detected in the sheet overlap detecting step. The error determining step is executed when the apparatus is powered on or before one of the sheets on the stacker is fed to the conveying path.

As described above, according to the present invention, the sheet overlap sensing device and the sheet sensing device are provided in the sheet conveying path, to which each of the sheets on the stacker is delivered. Further, the error determining device is provided for determining whether the sheet overlap detection is erroneous on the basis of the signal from the sheet sensing device and the signal from the receiving element of the sheet overlap sensing device. Accordingly, for example, when the sheet sensing device detects the absence of the sheet and the sheet overlap sensing device detects overlapping sheets, that is, the output value from the receiving element is smaller than the reference value, the error determining device determines that the detection is erroneous. Accordingly, it is possible to warn the user of a failure in the device through display.

Therefore, even if an error occurs in the sheet overlap detecting element owing to degradation or an external shock while the apparatus is in use, this can be promptly determined. The subsequent sheet conveyance can be controlled, so that the apparatus continues conveying the sheet while ignoring the sheet overlap detecting function.

DETAILED DESCRIPTION OF PREFERRED EMBODIMENT

Hereunder, embodiments of the present invention will be described in detail with reference to the accompanying drawings. The present invention relates to a device and method used in an image reading device or a sheet feeding section of a sheet handling apparatus such as a copier and a printer, to detect overlapping sheets in front of a processing device while separating and feeding each sheet from other sheets stacked on a stacker to a processing platen for reading image, printing, or the like.

Figure 1:
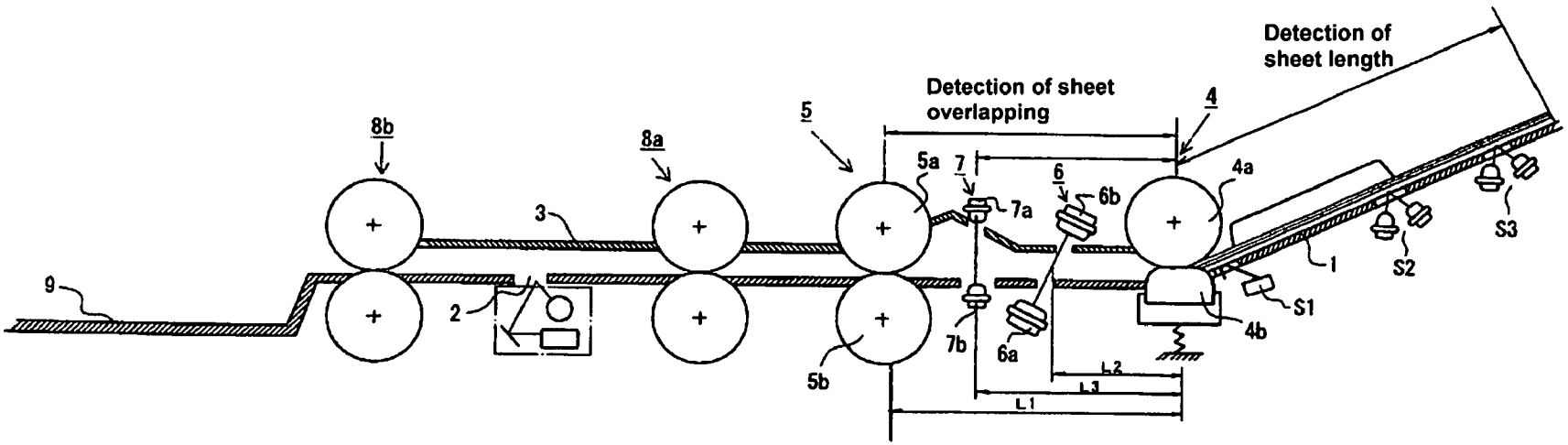
FIG. 1 is a schematic diagram showing an essential part of a sheet handling apparatus according to the present invention.
Figure 2:
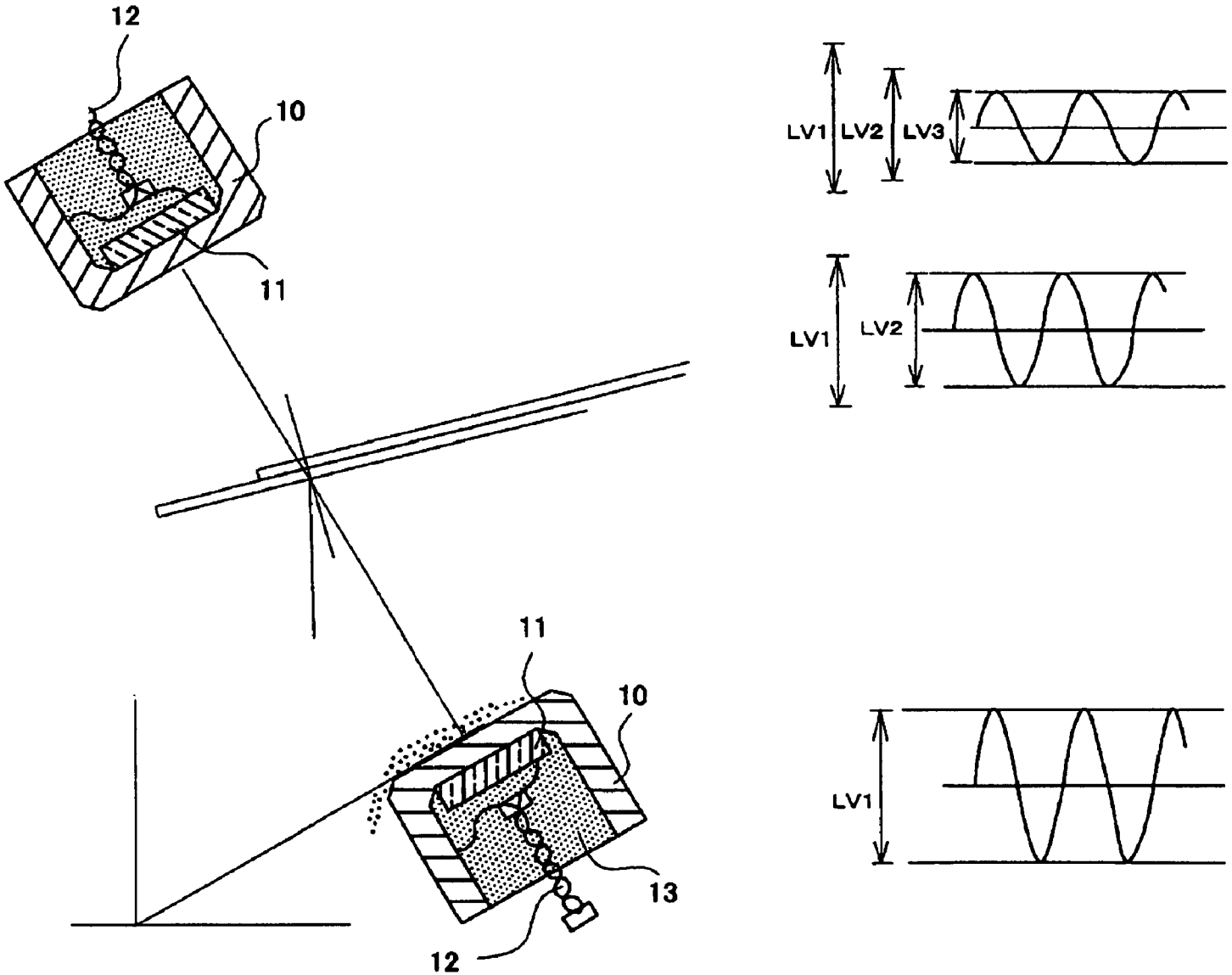
FIG. 2 is a schematic diagram of a structure of a sheet overlap sensing device with an ultrasonic sensor.
Figure 3A:
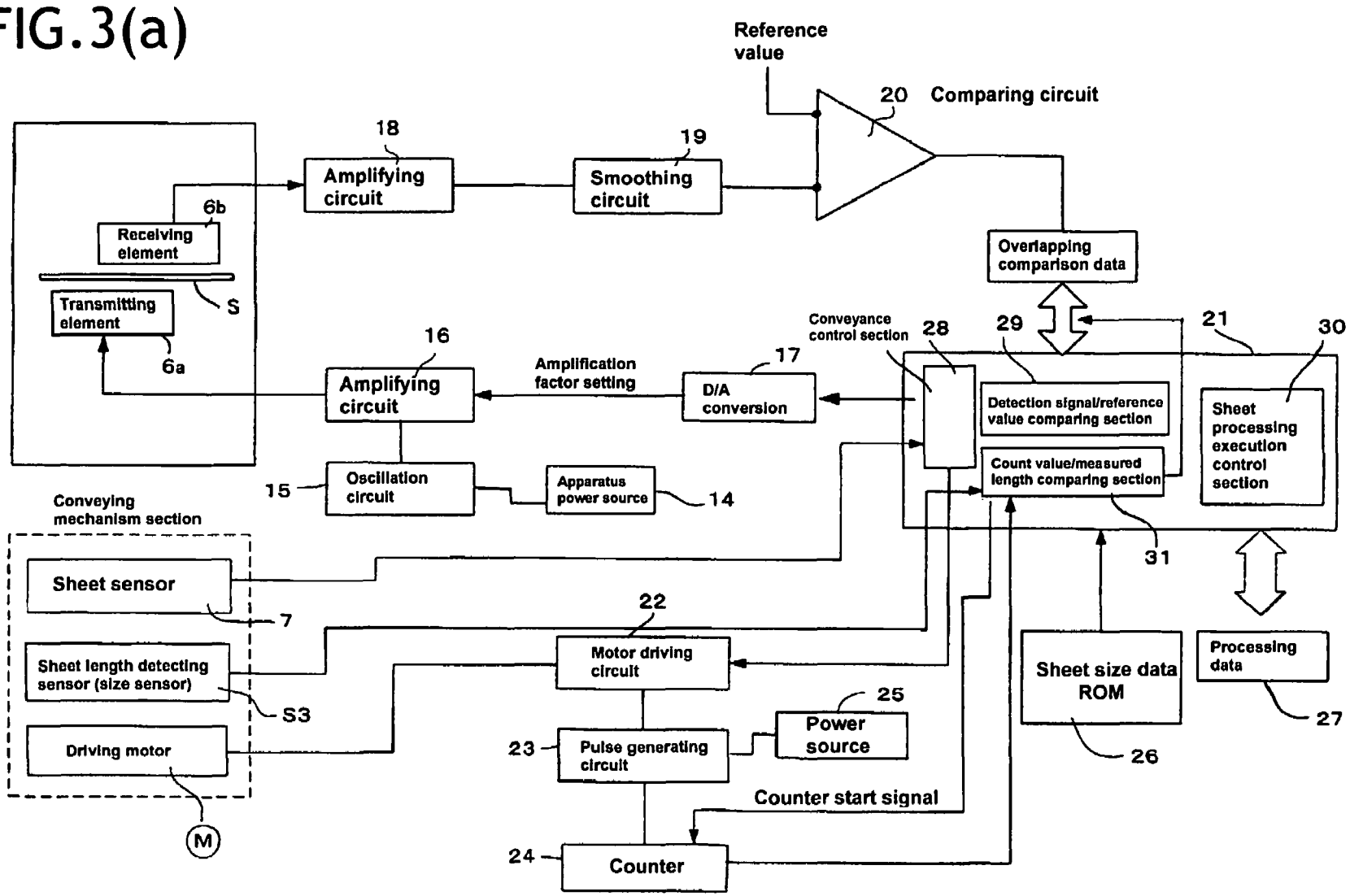
FIG. 3(*a*) is a schematic diagram showing a control circuit for sheet overlap detection in the apparatus shown in FIG. 1, and FIG. 3(*b*) is a schematic diagram showing a failure detecting circuit in the apparatus shown in FIG. 1.
Figure 3B:
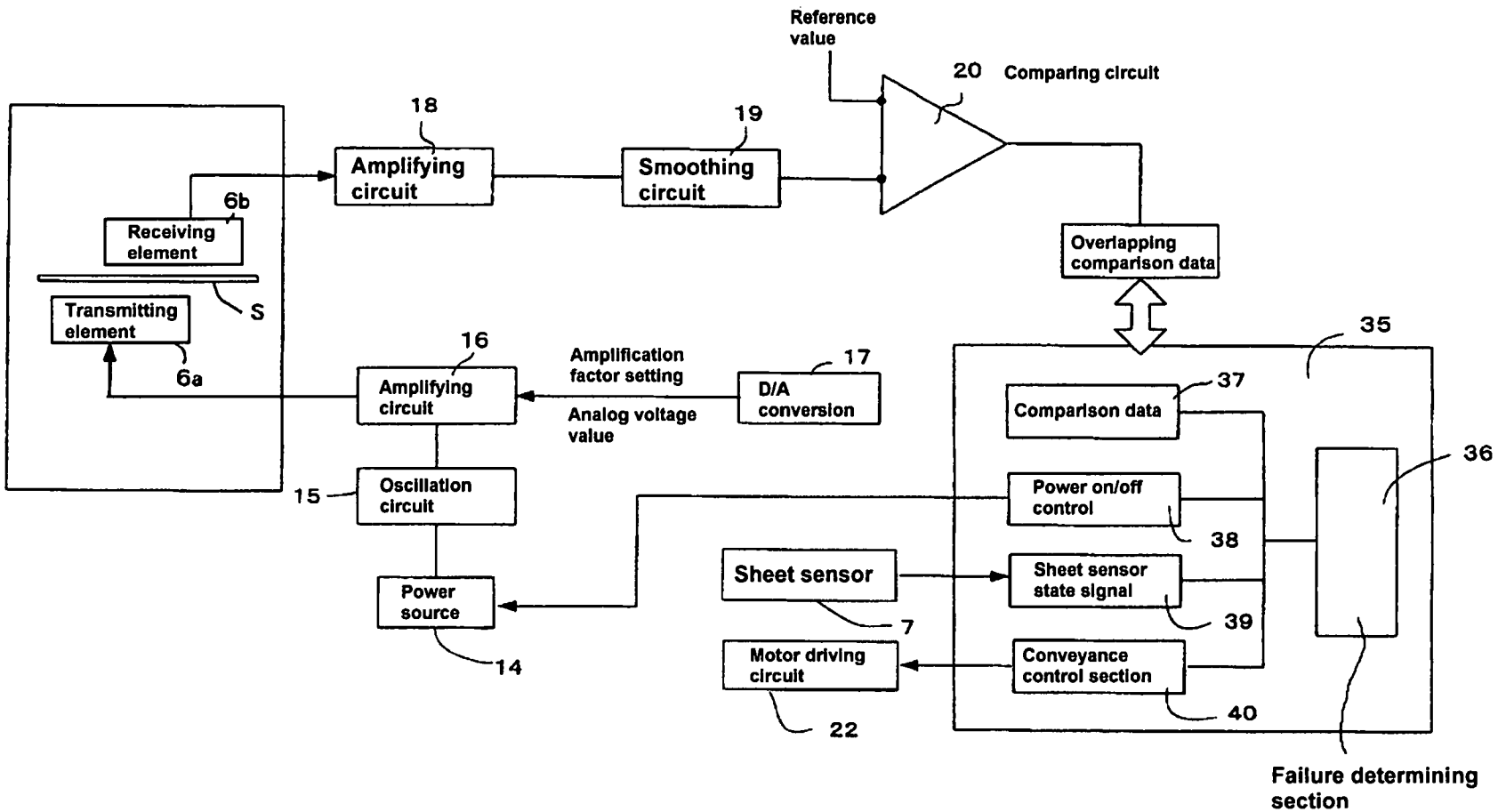

FIG. 1 is a diagram showing a sheet handling apparatus in which the present invention has been implemented. FIG. 2 generally shows a structure of a sheet overlap sensing device formed of an ultrasonic sensor. FIGS. 3(*a*) and 3(*b*) are diagrams showing a control circuit for the sheet overlap sensing device.

The apparatus shown in FIG. 1 comprises a stacker 1 in which sheets are stacked and housed; a conveying guide 3 that guides sheets from the stacker 1 to a processing platen 2; at least two conveying devices 4 and 5, first and second conveying devices, arranged on the conveying guide 3; and a sheet overlap sensing device 6 placed between the first conveying device 4 and the second conveying device 5 to detect overlapping sheets. A separating device separates each sheet from other sheets stacked on the stacker 1. The first and second conveying devices 4 and 5 feed the sheet to a processing position (processing platen 2). At the processing position, a predetermined process such as image reading, printing, sealing, or stapling is executed on the sheet. The sheet is then conveyed to a sheet discharging stacker 9.

The stacker 1 is normally composed of a tray on which sheets are placed. An empty sensor S1 and a size sensor S2 are appropriately mounted on the stacker 1 according to specifications of the apparatus. The empty sensor S1 detects whether or not a sheet is present, and the size sensor S2 detects the length of the sheet. The separating device is provided at the tip of the stacker 1 to sequentially separate the uppermost or lowermost sheet from the others and feed it.

The separating device employs any of various methods including a combination of a first conveying roller 4*a* and a friction pad 4*b*; a combination of a forward roller and a backward roller; and a combination of a sheet feeding roller and a separating pawl (corner separator). Some apparatuses are known to employ vacuum separation. The present invention can adopt any method of separating each sheet from the others stacked. The figure shows the first conveying roller 4*a* (or a belt), which rotates in a direction in which sheets are conveyed, and the friction pad 4*b*, which inhibits overlapping sheets. A sheet separated by the separating device 4 is fed to the platen 2. A register roller 5*a* or a conveying roller 8*a* is placed in a conveying path between the separating device 4 and the platen 2. The register roller 5*a* causes the sheet to stand by temporarily, and the conveying roller 8*a* receives and conveys the sheet from the first conveying roller 4*a* to the platen 2.

At least two conveying devices, in the present invention first and second conveying devices, are provided between the stacker 1 and the processing platen 2. In the illustrated apparatus, the first conveying roller 4*a* is defined as the first conveying device. The register roller 5*a* is defined as the second conveying device. The first and second conveying devices 4*a* and 5*a* are arranged such that a distance between the two conveying devices is shorter than a length of the minimum-sized sheet. The register roller 5 has a commonly known configuration in which the pair of rollers 5*a* and 5*b* contacted with each other under pressure bends a sheet from the separating roller 4*a* to correct skews and then supplies the sheet to the platen 2 at a predetermined time.

The sheet overlap sensor 6 and a sheet sensor 7 are placed between the first and second conveying rollers 4 and 5, and the sheet sensor 7 detects a tip of a sheet. The sheet overlap sensor 6 is composed of a transmitting element 6*a* and a receiving element 6*b* arranged opposite each other across the conveying guide 3. The sheet sensor 7 is composed of a transmitting element 7*a* and a receiving element 7*b* arranged opposite each other. The illustrated sheet overlap sensor 6 is an ultrasonic sensor. The transmitting element 6*a* and the receiving element 6*a* are composed of piezoelectric vibrators having the same structure. In the figure, reference numeral 8*a* denotes a conveying roller provided on the conveying guide 3 to control the speed of the sheet fed to the platen 2 at a predetermined value.

The sheet overlap sensor 6 is composed of an ultrasonic sensor including the transmitting element 6*a* and receiving element 6*b* arranged opposite each other. The transmitting element 6*a* and the receiving element 6*b* are composed of piezoelectric vibrators having the same structure as shown in FIG. 2. A piezoelectric vibrator 11 made of ceramic or the like is build into a cylindrical housing case 10 made of a metal material such as an aluminum alloy. The case 10 is filled with a synthetic resin 13. Electrode layers are deposited on a front and back surfaces of the piezoelectric vibrator 11. A lead 12 is connected to one of the electrode layers with the other end of the lead 12 electrically connected to the case for grounding. Accordingly, application of a high frequency voltage to the head 12 causes the piezoelectric vibrator 11 to vibrate at a predetermined frequency. Excitation of the piezoelectric vibrator 11 allows its electromotive force to be externally obtained.

A high frequency power source is connected to the transmitting element 6*a* as shown in FIG. 3(*a*). A device power source 14 is connected to a high frequency oscillation circuit 15. The oscillation circuit generates a high frequency voltage of, for example, 30 to 40 KHz. An amplifying circuit 16 amplifies and supplies the high frequency voltage to the transmitting element 6*a*. The piezoelectric vibrator 11 has its characteristic frequency set at a predetermined value. The piezoelectric vibrator 11 vibrates to provide an ultrasonic wave through the housing case 10. The amplifying circuit 16 has its amplification factor set by a control CPU. An instruction signal from the CPU is subjected to a D/A conversion, so that the converted signal is transmitted to the amplifying circuit 16.

The ultrasonic wave provided by the transmitting element 6*a* propagates to the receiving element 6*b* via a sheet S in the conveying guide 3. In the receiving element 6*b*, the case 10 is excited by the ultrasonic wave propagated through the sheet. The piezoelectric vibrator in tight contact with the case 10 is thus vibrated. An electromotive force generated by the vibration of the piezoelectric vibrator 11 is lead to the lead 12 through the electrode, so that a current is output as a detection value proportional to amplitude of the piezoelectric vibrator 11.

An amplifying circuit 18 is connected to the receiving element 6*b* to amplify the detection current generated in the piezoelectric vibrator 11. A smoothing circuit 19 is connected to the amplifying circuit 18. The smoothing circuit 19 is composed of an integration circuit for averaging and sending the detection current in the amplification wave to a comparing circuit 20. The comparing circuit 20 compares the detection current from the smoothing circuit 19 with a preset reference value. The reference value is determined as follows.

Figure 4A:
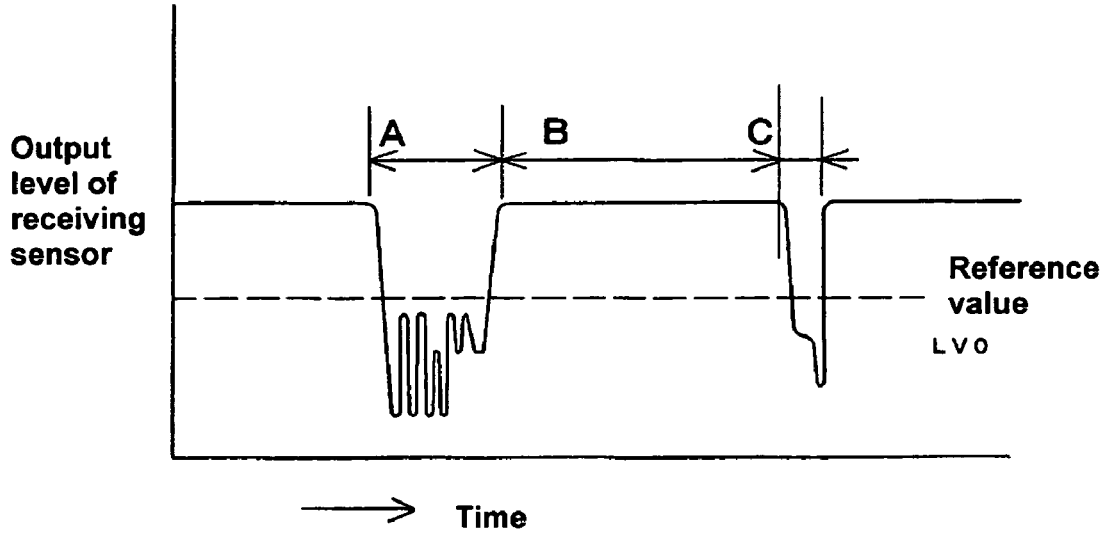
FIGS. 4(*a*) and 4(*b*) are charts showing waveforms of output signals from the ultrasonic sensor shown in FIG. 2, wherein FIG. 4(*a*) shows a non-sheet-overlapping state and FIG. 4(*b*) shows a sheet-overlapping state.
Figure 4B:
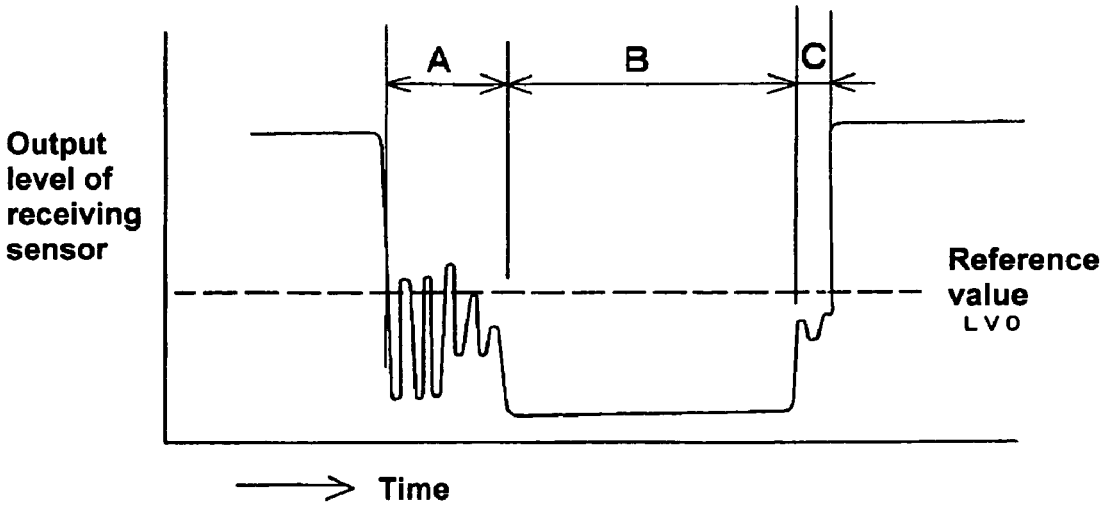

FIGS. 4(*a*) and 4(*b*) show output values (analog voltages) from the smoothing circuit 19. FIG. 4(*a*) shows an output value obtained when one sheet is fed to the conveying path. FIG. 4(*b*) shows an output value obtained when two sheets are fed to the conveying path. The sheet delivered by the stacker 1 travels from the first conveying roller 4*a* to the second conveying roller 5*a*. In the figure, reference character A denotes an output value obtained while the sheet is traveling from the first conveying roller 4*a* to the second conveying roller 5*a*, the output value exhibiting an unstable waveform. In the figure, reference character B denotes an output value obtained while the sheet is held by both first conveying roller 4*a* and second conveying roller 5*a*, the output value exhibiting a stable waveform. In the figure, reference character C denotes an output value obtained while the sheet is held by the second conveying roller 5*a* with its trailing end leaving the first conveying roller 4*a*, the output value exhibiting an unstable waveform.

In the area B with the stable waveform, the level of the output value differs clearly between the case of one sheet and the case of two sheets. With one sheet, the amount of ultrasonic wave attenuated upon passing through the sheet is small and the detection current is large. When two or more sheets overlap, the amount of ultrasonic wave attenuated is large and the detection current is small. The reference value is set larger than that of a detection current for one sheet and smaller than that of a detection current for two sheets. The detection current is output by the above smoothing circuit while the sheet is held by the longitudinal pair of conveying rollers 4*a* and 5*a*. The reference value in this case varies depending on a thickness or a material of the sheets or the like. Accordingly, the reference value is experimentally determined for various sheets selected in accordance with the specifications of the apparatus.

Comparison data from the comparing circuit 20 is transferred to the control CPU (control circuit) 21. The control CPU 21 connects to size sensors S2 and S3 arranged on the stacker 1, the sheet sensor 7, and a sheet discharge sensor (not shown) placed on the conveying guide 3. The sheet sensor 7 is placed between the first conveying roller 4*a* and the second conveying roller 5*a* to transmit timing when the leading end of the sheet arrives to the control CPU 21.

The control CPU 21 connects to a motor control circuit 22 for a driving motor M that drives the first and second conveying rollers 4*a* and 5*a*, so that the control CPU 21 can transmit a command signal to the motor control circuit 22. The motor control circuit 22 has a power source 25 connected to a pulse generator 23 to which a pulse current is supplied. The driving motor M, which receives power from the power source 25, is composed of a stepping motor. A counter 24 is connected to the pulse generator 23 to count a pulse current supplied to the driving motor M. The counter 24 is connected to the control CPU 21.

Figure 5:
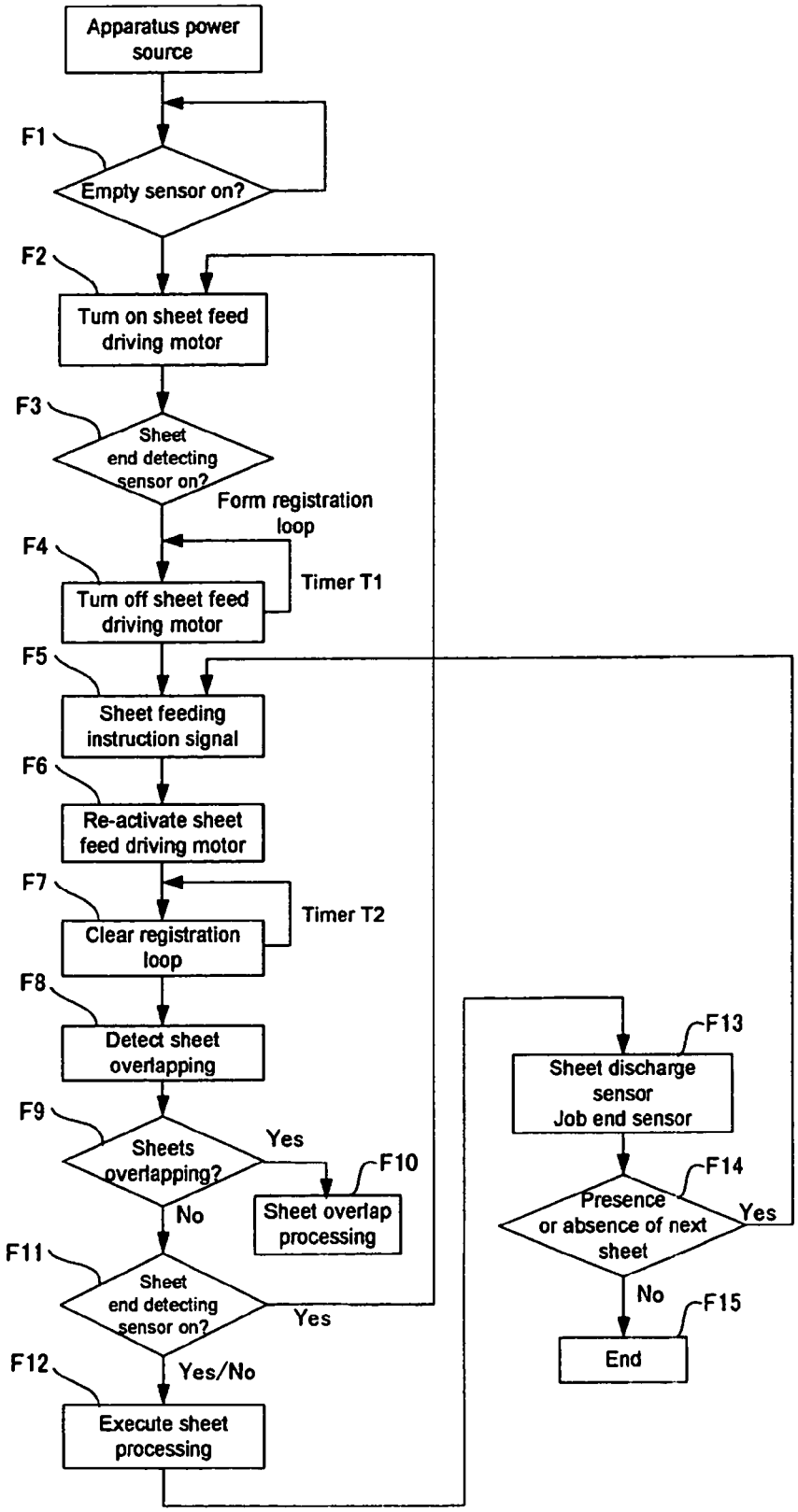
FIG. 5 is a flowchart showing a sheet overlap detection process executed in the apparatus shown in FIG. 1.

With reference to the flowchart in FIG. 5, description will be given of an operation performed by the apparatus configured as shown in FIG. 1 to detect overlapping sheets. A control program for the CPU 21 configures a conveying control section 28 as described below.

When the apparatus power source 14 is turned on, the CPU 21 determines from a state signal from the empty sensor Si whether or not there is any sheet on the stacker 1 (F1). If there is any sheet, the CPU 21 provides an actuation signal to the motor control circuit 22. The motor control circuit 22 supplies pulse power from the power source to the driving motor M via the pulse generator 23. The actuation of the driving motor M (F2) causes the first conveying roller 4*a*, connected to the driving motor M, to rotate clockwise in FIG. 1 to deliver one of the sheets on the stacker 1.

When the first conveying roller 4*a* delivers each sheet, the friction pad 4*a* separates the sheet from the others. The sheet thus advances to the conveying guide 3 with its leading end traveling to the second conveying device 5 via the sheet overlap sensor 6 and then the sheet sensor 7. At this time, the second conveying device 5 is stopped. The leading end of the sheet abuts against a pressure contact portion of the second rollers 5*a* and 5*b* to bend and make a loop. Once the leading end of the sheet reaches the sheet sensor 7, the conveyance control section 28 receives a sensing signal from the sheet sensor 7 to actuate a timer (F3). Then, once a time T1 has passed, the driving motor M is stopped (F4).

Then, the CPU 21 receives a signal for the start of processing such as image reading or printing from the apparatus main body as a sheet feed instructing signal (F4). In response to this signal, the CPU 21 re-actuates the driving motor M. In the figure, a transmission mechanism is composed of a one way clutch, so that the rotation of the driving motor M (selectively) rotates the first conveying roller 4*a* and the second conveying roller 5*a* in opposite directions. A forward rotation of the driving motor M rotates the first conveying roller 4*a*, while a backward rotation of the driving motor M rotates the second conveying roller 5*a*.

Accordingly, the re-actuation of the driving motor M rotates the second conveying roller 5*a*. With the first conveying roller 4*a* stopped, the second conveying roller 5*a* feeds the sheet to the conveying roller 8*a* (F6). At the same time, the conveyance control section 28 of the CPU 21 actuates a timer T2 (F7). The time for the timer T2 is set such that T1 is smaller than T2 in order to return the looped sheet to its original state. Once the predetermined time for the timer T2 has passed, the CPU 21 provides an instruction signal for sheet overlapping detection (F8). Upon receiving this signal, a detection signal/reference value comparing section 29 in the CPU 21 receives sheet overlapping comparison data shown in FIG. 3(*a*) to determine whether or not sheet overlapping is occurring (F9). For the sheet overlapping detection (determination), the CPU 21 determines that two or more sheets are overlapping when the data from the comparing circuit 20 indicates that the detection value from the receiving element 6*b* is smaller than the preset reference value (LV0 in FIG. 2). The data is obtained by comparing the detection value with the reference value.

In order to prevent erroneous detections that may occur if the detection value from the receiving element 6*b* is varied by the vibration of the sheet or other external factors, the detection signal/reference value comparing section 29 in the illustrated configuration detects overlapping sheets when two or more sheets bent and looped by the second conveying device 5 so as to form an air layer between the overlapping sheets are returned to their original state. Further, the detection signal/reference value comparing section 29 makes determination on the basis of an average obtained by carrying out detections when the sheet is nipped between the first conveying roller 4*a* and the second conveying roller 5*a* and after the sheet has been conveyed by a predetermined distance (length).

If the detection signal/reference value comparing section 29 determines that overlapping sheets are occurring, the CPU 21 executes sheet overlap processing (F10). In the sheet overlap processing, the apparatus is stopped, and the user removes the sheets from the conveying guide 3 and re-sets them on the stacker 1. Alternatively, the sheets are conveyed to the sheet discharging stacker 9 without being processed by the processing platen 2, and this state (overlapping sheets) is indicated on an operation panel. If the detection signal/reference value comparing section 29 determines that conveyance is being carried out normally (overlapping sheets are not occurring), the second conveying roller 5*a* and the conveying roller 8*a* feeds the sheet to the processing platen 2 to execute predetermined sheet processing (F12). Then, when the trailing end of the sheet passes by the sheet sensor 7, the CPU 21 senses a state signal from the sheet sensor 7 to drive the driving motor M (F2). Thus, the next sheet is delivered in the above manner.

The conveying roller 8*a* is connected to a driving motor different from the driving motor M to feed a sheet to the processing platen 2 at a predetermined sheet. Sheets subjected to the predetermined processing at the processing platen 2 are sequentially accommodated in the sheet discharging stacker 9. The sheet discharge sensor, provided at a sheet outlet of the sheet discharging stacker 9, detects that the sheet has been housed (F13). In response to a state signal from the empty sensor 1 indicating whether or not there is any sheet on the stacker 9, the CPU 21 determines whether or not the series of jobs have been finished (F14). When the empty sensor 1 indicates the presence of the next sheet, the CPU 21 provides a sheet feed instructing signal (F5) to feed the next sheet to the processing platen 2.

The above operations have been described in connection with common sheet feeding steps. For a scanner apparatus using a processing platen that sequentially reads images from sheets, the conveyance control section 28 executed in the CPU 21 controls the speed of the driving motor M as follows.

On the basis of a signal from the scanner apparatus, the conveyance control section 28 sets the conveyance speed of the first conveying device 4 and conveying roller 8*a* in accordance with sheet processing conditions. The conveyance speed is determined by the scanner apparatus in accordance with image reading conditions. The conveyance speed varies depending on whether images are colored or monochromatic and whether reading resolution is high or low. In general, a low conveyance speed is set for color images and a high resolution. A high resolution is set for monochromatic images and a low resolution. The speed may be greatly varied depending on the conditions.

According to the present invention, a failure determining device (circuit 35, described below) is provided in the apparatus in FIG. 1 and in the circuit configuration in FIG. 3(*a*) described above. In the sheet overlap sensing device 6, the transmitting element 6*a* and receiving element 6*b* of the ultrasonic sensor are arranged opposite each other via a sheet in the conveying guide 3. The sheet sensor 7 is placed near both elements 6*a* and 6*b*.

The control CPU 21 is provided with a failure determining section 35 described below. A failure determining section 36 (calculating circuit) is provided for connecting result data provided by the comparing circuit 20 by comparing the output value from the receiving element 6*b* with the preset reference value; comparison data 37 shown in FIG. 3(*b*); a power on/off control signal 38 that controls a power supply to the transmitting element 6*a*; a state signal 39 from the sheet sensor 7 indicating the presence or absence of a sheet; and a control signal 40 for the driving motor M.

The failure determining section 36 is configured to determine that the device is defective when the signals are in the following conditions.

(1) The sheet sensor 7 indicates the absence of a sheet and the comparison data indicates overlapping sheets (the output value is smaller than the reference value).

(2) The power on/off control signal 38 indicates an off state (the transmitting element is inactive) and the comparison data indicates a normal state (non overlapping sheets; the output value is larger than the reference value).

In (1), when no sheet is present (located) in the sheet overlap sensing device 6, the output value detected by the receiving element 6*b* indicates that two or more sheets are overlapping. The failure determining section 36 determines that any arrangement in the transmitting element 6*a* or receiving element 6*b* is defective. In (2), although the transmitting element 6*a* is inactive, the output value from the receiving element 6*b* is larger than the reference value. The failure determining section 36 determines that any arrangement in the receiving element 6*b* is defective. Thus, according to the present invention, the above defective state is automatically detected using the following configuration.

The defective state is determined by the sheet sensor 7 while no sheet is located in the sheet overlap sensing device 6. This is to prevent the detection from being affected by, for example, the moving speed or flapping of a sheet (the determination in (2) is possible regardless of the presence of a sheet).

The failure determination in (1) and/or (2) is carried out during the initialization of the apparatus, before a sheet on the stacker reaches the position of the sheet overlap sensing device, or after the jobs have been finished, that is, all the sheets on the stacker have been conveyed.

Figure 6:
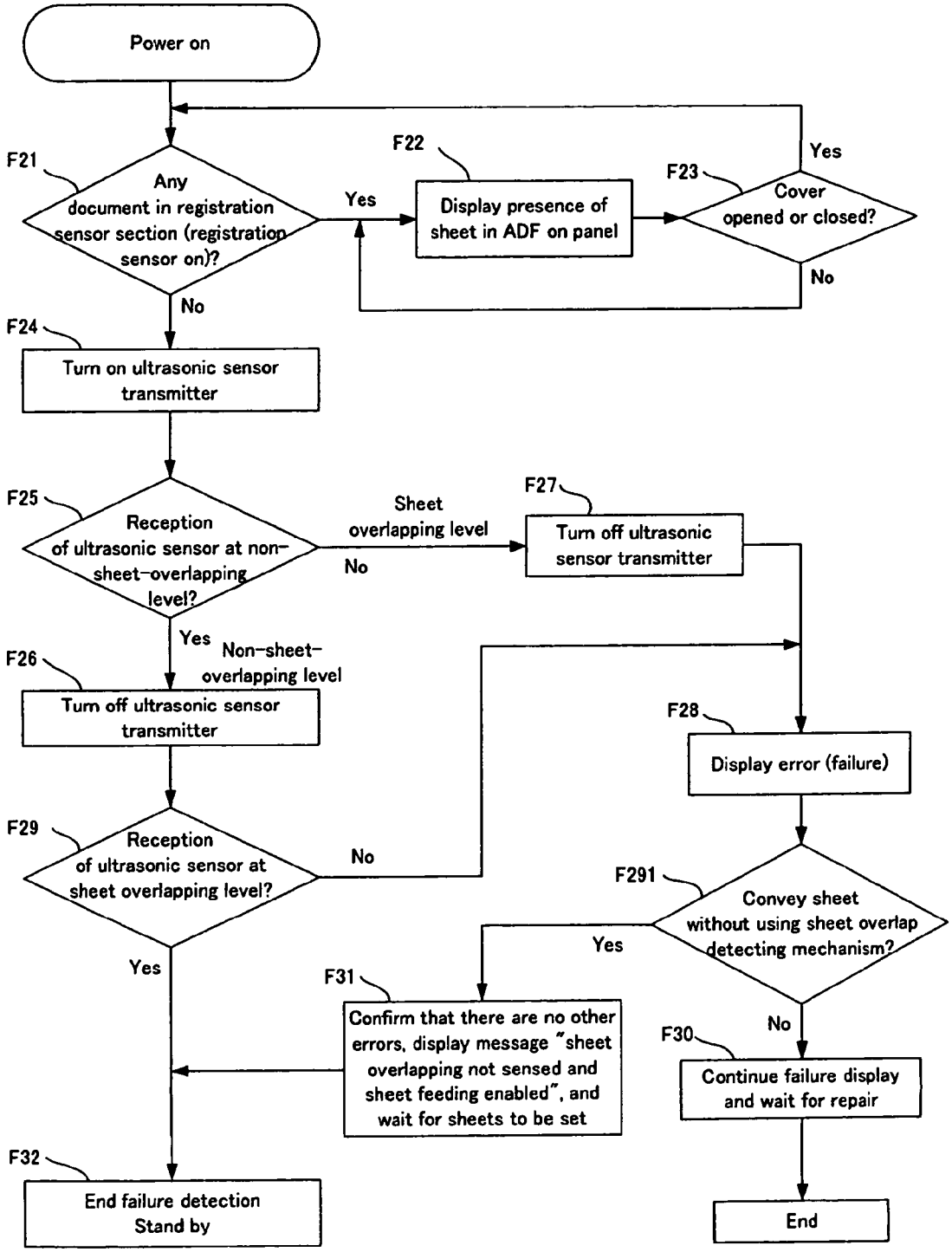
FIG. 6 is a flowchart showing an initialization process of the apparatus shown in FIG. 1.

FIG. 6 shows an operational flow executed during the initialization. In FIG. 6, upon receiving a signal indicating that the apparatus power source has been turned on (F20), the control CPU 21 causes the sheet sensor 7 to sense whether or not there is any sheet (F21). If there is any sheet, the sheet may be jammed in the conveying guide 3. Accordingly, a display panel indicates the need to remove the jammed sheet (F22). The sensor then senses whether or not a cover that opens the conveying path has been opened (F23).

In response to a signal from the sheet sensor 7 indicating the absence of a sheet (F21), the control CPU 21 turns on a power supply to the transmitting element 6*a* of the ultrasonic sensor (F24). The control CPU 21 then determines whether or not sheet overlap comparison data indicates non overlapping sheets (a normal state) (F25). The sheet overlap comparison data is obtained by comparing an amplified and smoothed output value with the reference value and is output by the receiving element 6*b* a predetermined time (the time required for the sensor to respond: for example, 10 msec) after power has been supplied to the transmitting element 6*a*. In this case, the failure determining section 36 of the control CPU 21 determines whether the sheet overlap comparison data indicates overlapping sheets (the output value from the receiving element is smaller than the reference value) or non overlapping sheets (the output value from the receiving element is larger than the reference value).

When the sheet overlap comparison data indicates overlapping sheets, the failure determining section 36 determines that the device is defective. The failure determining section 36 then turns off the power supply to the transmitting element 6*a* (F27) and displays the failure (F28). The failure determining section 36 inquires of the operator as to whether or not to execute a sheet feeding process without using the sheet overlap detecting function (F29). If a sheet is to be fed (F31), the failure determining section 36 waits sheets to be set on the stacker. On the other hand, if the sheet feeding process has not been selected, the failure determining section 36 displays the failure (F30) and stops the apparatus.

On the other hand, when the sheet overlap comparison data indicates non overlapping sheets (normal state), the failure determining section 36 turns off the power supply to the transmitting element 6*a* (F26). The failure determining section 36 then determines whether the sheet overlap comparison data based on the output value from the receiving element 6*b* indicates overlapping sheets or non overlapping sheets (F29). If the data indicates overlapping sheets, the failure determining section 36 determines that the device is normal to end this failure diagnosis (F32). If the data indicates non overlapping sheets, the failure determining section 36 determines that the device is defective to display the failure (F28). The failure determining section 36 executes the failure operations in F29, F30, and F31 as previously described.

Figure 7:
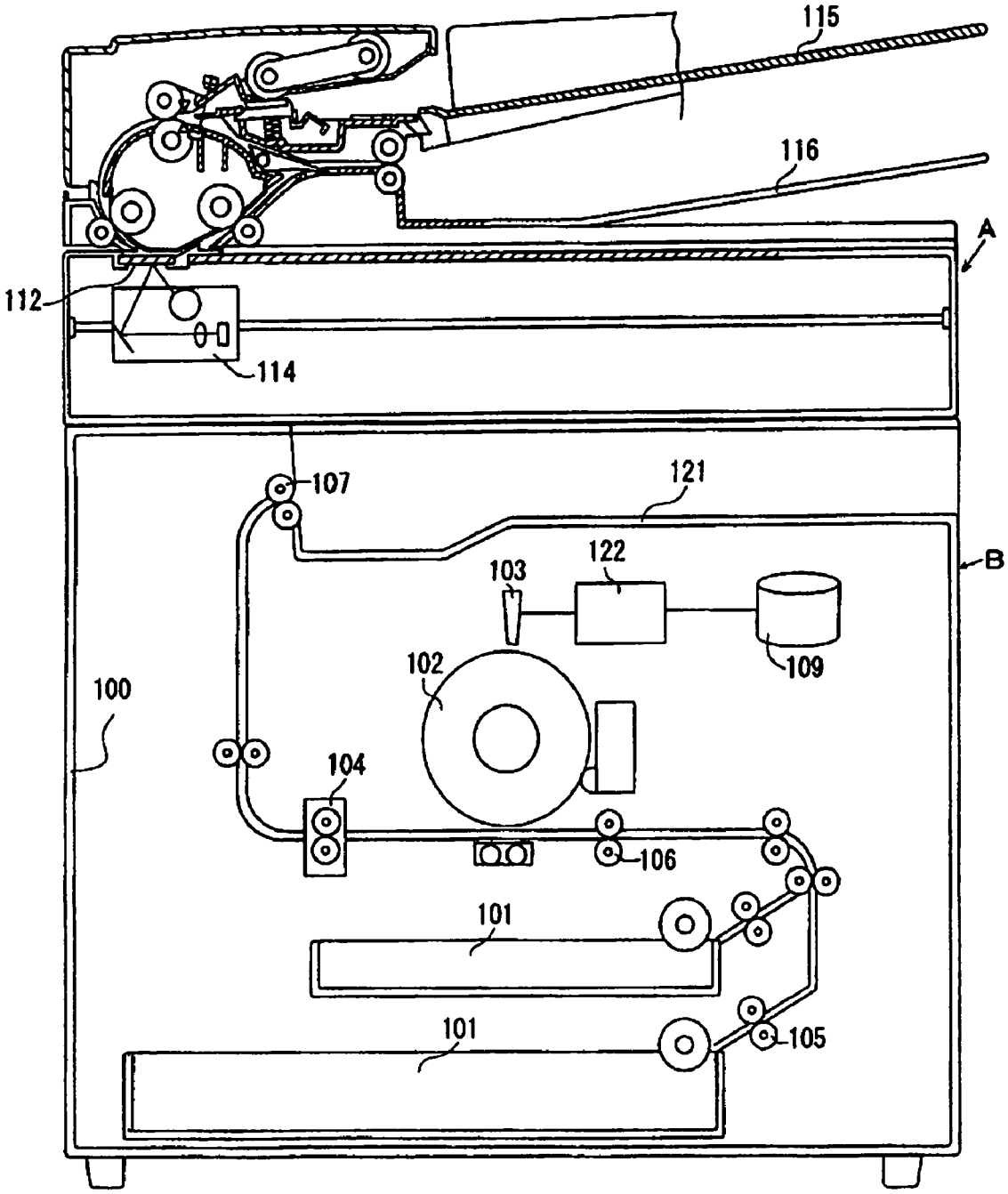
FIG. 7 is a diagram showing an image reading device and an image forming apparatus comprising the image reading device as a unit according to the present invention.
Figure 8:
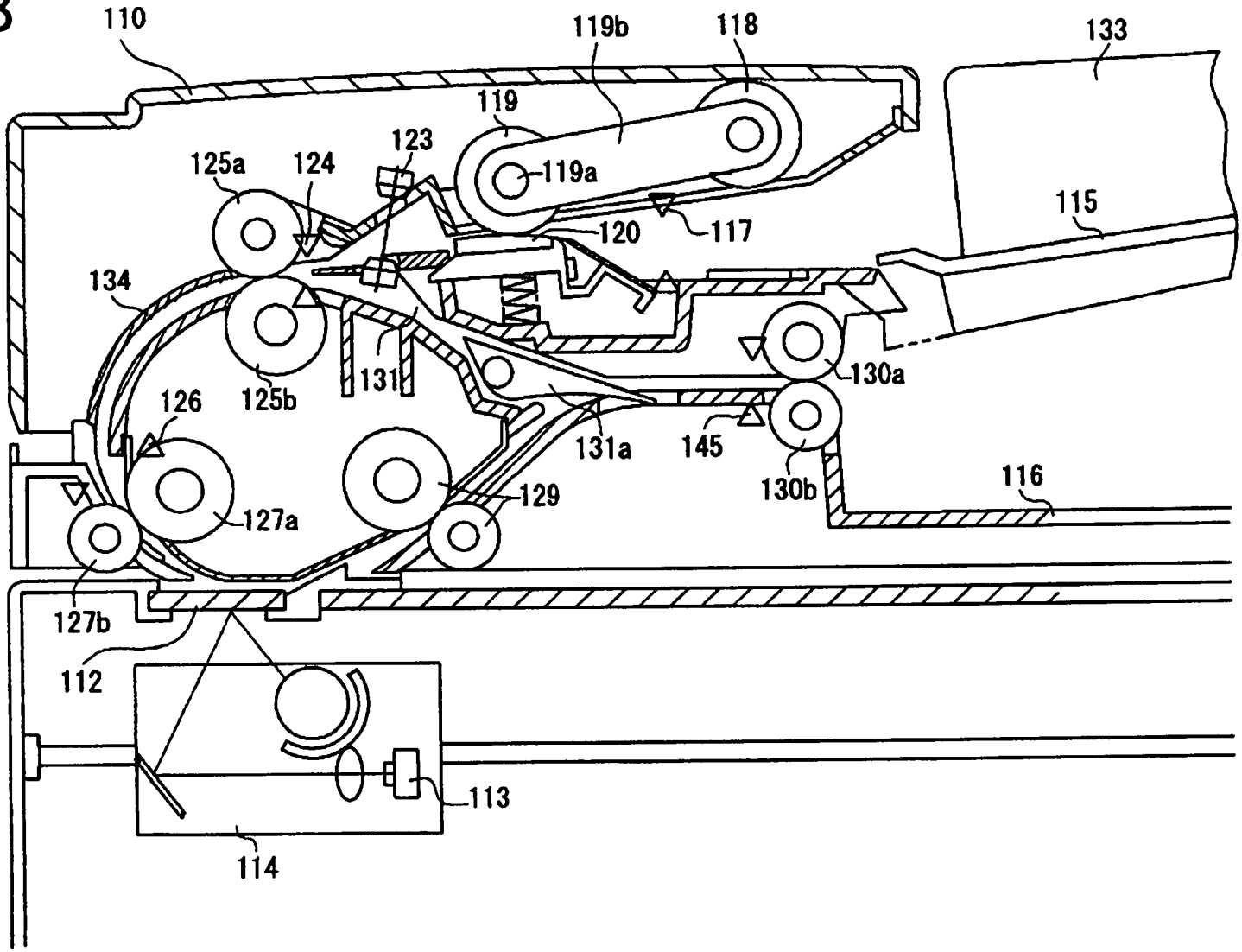
FIG. 8 is a detailed diagram showing a document sheet supplying section of the apparatus shown in FIG. 7.

An image reading device according to the present invention will be described next. FIG. 7 shows an image reading device A and an image forming apparatus B comprising the image reading device A as a unit. FIG. 8 shows a sheet feeding section in detail.

The image forming apparatus B, comprising the image reading device A, described later, has a printing drum 102; a sheet feeding cassette 101 from which sheets are fed to the printing drum 102;, a developing machine 108 that develops an image on the printing drum 102 using toner ink; and a fixer 104. All these components are built into a casing 100. Reference numeral 103 denotes a print head that uses a laser or the like to form a latent image on the printing drum 102. The conveying roller 105 feeds a sheet from the sheet feeding cassette 101 to the printing drum 102. An image formed by the print head 103 is then transferred to the sheet and fixed by the fixer 104. The sheet discharging roller 107 then houses the sheet on which the image has been formed in the sheet discharging stacker 121.

Such an image forming apparatus B is commonly known as a printer, and is composed of a sheet feeding section, a printing section, and a sheet discharging and housing section. The functional sections of the image forming apparatus are not limited to the above structure. For example, ink jet printing or silk screen printing may be adopted for the image forming apparatus.

The print head couples electrically to a storage device 122 such as a hard disk in which image data is accumulated and a data management control circuit 109 that sequentially transfers the accumulated image data to the print head.

The image reading device A is mounted above the image forming apparatus. The image reading device A has a platen 112 mounted on the casing 110, and an optical mechanism 114 and a photoelectric converting element 113 are arranged in the device A to read an image on a document sheet via the platen 112. A CCD is commonly used as the photoelectric converting element 113.

A sheet feeding device C shown in FIG. 8 is installed on the platen 112. The sheet feeding device C has a sheet feeding stacker 115 and a sheet discharging stacker 116 arranged above the platen 112 in parallel in a vertical direction. A sheet from the sheet feeding stacker 115 is guided to the sheet discharging stacker 116 through a U-shaped conveying path 134 via the platen 112.

The sheet feeding stacker 115 has an empty sensor 117 and a size sensor 132 arranged in the stacker 115 to detect whether or not there is any sheet stacked on the sheet feeding stacker 115. In the figure, reference numeral 133 denotes a side guide that regulates side edges of the sheets. The size sensor 132 and the size guide 133 will be described below with reference to FIG. 9.

A separating roller 119 and a fixed roller 120 are arranged at an upstream side of the sheet feeding stacker 115, and the fixed roller 120 is contacted with the separating roller 119 under pressure. A kick roller 118 is attached to a bracket 119*b* attached to a rotating shaft 119*a* of the separating roller 119. Clockwise rotation of the rotating shaft 119*a* lowers the kick roller 118 onto the sheet feeding stacker 115. Counterclockwise rotation of the rotating shaft 119*a* raises the rotating shaft 119*a* to the illustrated state. This mechanism will be described below in detail.

A sheet overlap sensing device 123 and a sheet end detecting means 124 are arranged in a conveying path 134 at a downstream side of the separating roller 119. The sheet overlap sensing device 123 detects overlapping sheets, and the sheet end detecting means 124 detects the leading and trailing ends of a sheet. A pair of register rollers 125*a* and 125*b*; feeding rollers 127*a* and 127*b*; a conveying roller 129; and sheet discharging rollers 130*a* and 130*b* are provided in the conveying path 134 in the this order for cooperatively conveying a sheet to the sheet discharging stacker 116.

In the figure, reference numeral 126 denotes a lead sensor that detects the leading end of a sheet. Reference numeral 128 denotes a guide that backs up the sheet at the position of the platen 112. In the figure, reference numeral 131 denotes a circulating path through which a sheet is re-fed from the platen 112 to the register rollers 125*a* and 125*b* using a path switching gate 131*a*.

Figure 9:
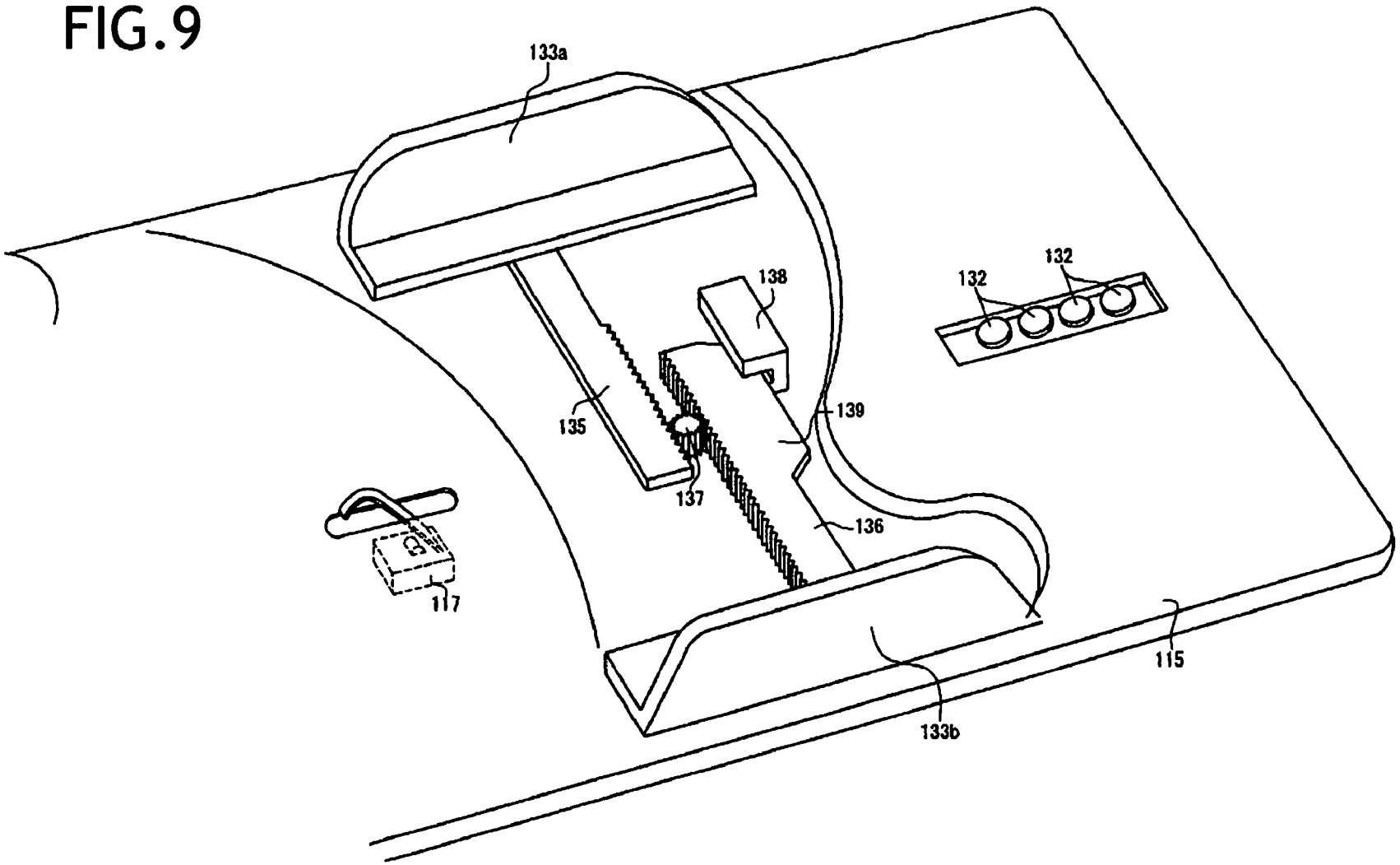
FIG. 9 is a perspective view showing a sheet feeding stacker in the apparatus shown in FIG. 8.

The side guide 133 and the size sensor 132 will be described with reference to FIG. 9. The sheet feeding stacker 115 is provided with a lateral pair of side guides 133*a* and 133*b* for regulating the side edges of a sheet. The side guides are mounted so as to be freely movable in a width direction. Racks 135 and 136 are integrated with the left and right guides 133*a* and 133*b*, respectively. The racks 135 and 136 interlock with a pinion 137 rotatably fixed to the sheet feeding stacker 115.

Accordingly, the left and right guides 133*a* and 133*b* are moved by the pinion 137 at the same increments in the opposite directions. One of the racks 136 is provided with a detecting piece 139 formed of a projection at a position corresponding to the width size of a sheet. A position sensor 138 is attached to a bottom surface of the stacker 115 to detect the position of the detecting piece 139. The position sensor 138 is composed of Slidax for changing a resistance value depending on a length over which it engages with the detecting piece 139. A position of the side guide 133 can be sensed on the basis of a detection output from the position sensor 138. A plurality of size sensors 132 is arranged on the stacker 115 to detect the trailing end of the sheet.

The position sensor 138 detects the width direction of a sheet on the stacker 115. The size sensor 132 can distinguish sheets of the same width size from one another. Thus, the size of the sheet is sensed.

Figure 10A:
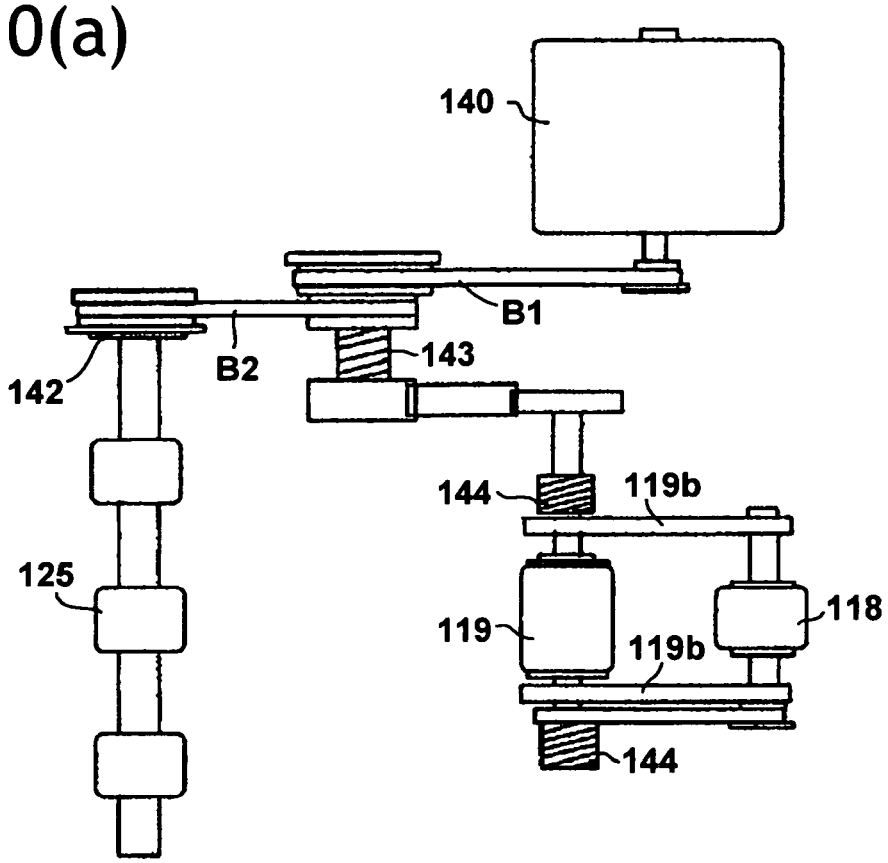
FIGS. 10(*a*) and 10(*b*) are diagrams showing a driving mechanism of the apparatus shown in FIG. 9, wherein FIG. 10(*a*) shows a sheet feeding section and FIG. 10(*b*) shows a conveying section.
Figure 10B:
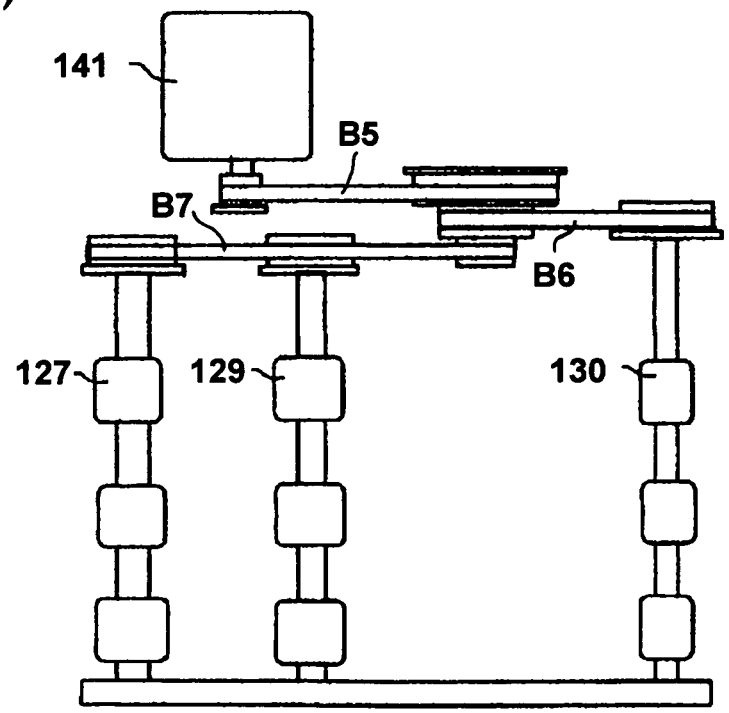
Figure 11A:
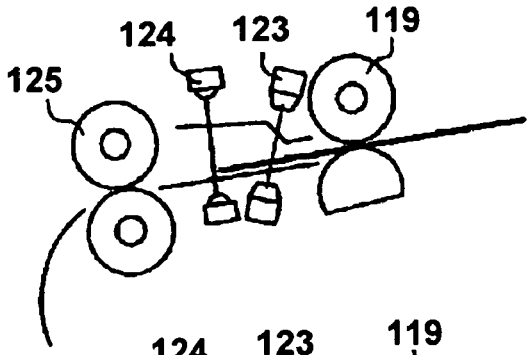
FIGS. 11(*a*) to 11(*e*) are schematic diagrams showing a sheet supplying operation of the apparatus shown in FIG. 8.
Figure 11B:
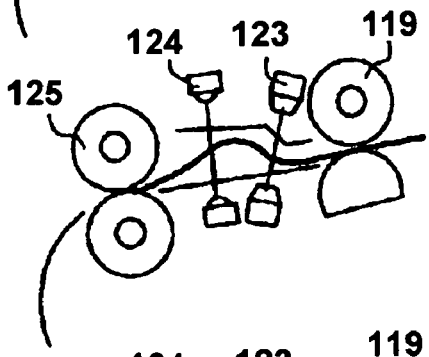
Figure 11C:
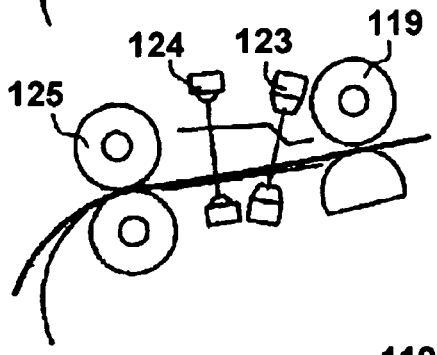
Figure 11D:
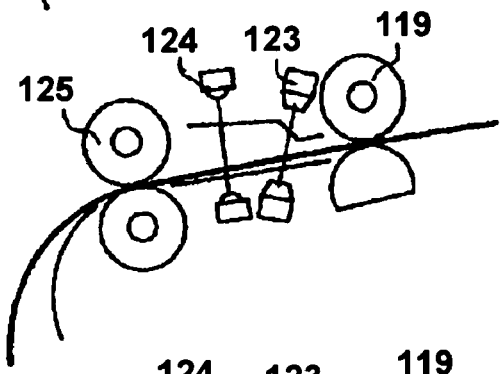
Figure 11E:
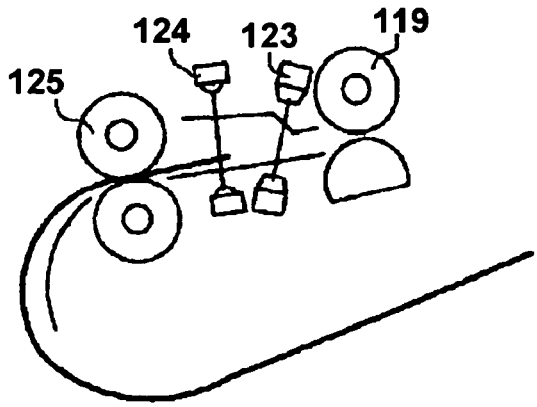

FIGS. 10(*a*) and 10(*b*) show driving mechanisms for the separating roller 119 and the register roller 125. The kick roller 118, the separating roller 119, and the register roller 125 are driven using a sheet feed driving motor 140 that can rotate forward and backward. A conveyance driving motor 141 is used to drive the feeding roller 127, the conveying roller 129, and the sheet discharging roller 130. Forward rotation of the sheet feed driving motor 140 rotationally drives the kick roller 118 and the separating roller 119. Backward rotation of the sheet discharging roller 130 rotationally drives the register roller 125. The sheet feed driving motor 140 also controls the elevation and lowering of the kick roller 118. The sheet feed driving motor 140 transmits only rotations in one direction to the register roller 125 via the belts B1 and B2 using a one way clutch 142. The sheet feed driving motor 140 is also connected to a rotating shaft of the separating roller 119 using a one way clutch 143, so that the one way clutches 142 and 143 relatively transmits driving.

A bracket 119*b* is supported on the rotating shaft of the separating roller 119 via a spring clutch 144. A transmission belt B3 is used to transmit driving to the kick roller 118, attached to the bracket 119*b*. Forward rotation of the sheet feed driving motor 140 rotationally drives the separating roller 119 and the kick roller 118, while loosing the spring of the spring clutch 144 to release the bracket 119*b*. The bracket 119*b* thus lowers from the elevated and retracted position shown in FIG. 7 to bring the kick rocker 118 into contact with the sheet on the stacker. Backward rotation of the sheet feed driving motor 140 transmits driving to the register roller 125, while contracting the spring clutch 144 to elevate the bracket 119*b* to the retracted position shown in FIG. 8.

The conveyance driving motor 141 is connected to the feeding roller 127, conveying roller 129, and sheet discharging roller 130 via belts B5, B6, and B7. Rotation of the conveyance driving motor 141 always rotates the feeding roller 127 and the conveying roller 129 in one direction regardless of the direction of rotation of the conveyance driving motor 141. Forward or backward rotation of the conveyance driving motor 141 rotates the sheet feeding roller 130 forward or backward, respectively.

A sensor is placed in the conveying path 134 to detect the arrival of the leading end of a sheet. The sensor and its operations will be described below. The plurality of size sensors are arranged on the sheet feeding stacker 115 to detect the specified size of set sheets. The size sensors 132 detect the size of a sheet to control the subsequent sheet conveyance. The empty sensor 117 is provided at the tip of the sheet feeding stacker 115 to detect whether or not there is any sheet on the stacker. The empty sensor 117 detects that the final sheet has been fed to send a signal to a processing device such as the image reading device A. The sheet overlap sensing device 123 and the sheet sensor 124 are provided downstream of the separating roller 119.

The lead sensor 126 is provided in front of the pair of feeding rollers 127 to notify the image reading device that the leading end of a sheet has arrived. The lead sensor 126 further indexes a start line for printing or the like. If the lead sensor 126 does not detect any sheet a predetermined time after a feed instructing signal for the register roller 125, it determines that a jam is occurring. The lead sensor 126 thus stops the driving motor and at the same time, provides a warning signal. The sheet discharge sensor 145 is placed downstream of the pair of conveying rollers 129 to detect the leading and trailing ends of a sheet to determine whether or not a jam is occurring.

An operation of the apparatus will be described. The apparatus power source is turned on, and sheets are set (placed) on the sheet feeding stacker 115. The sheet setting causes the empty sensor 117 to detect the presence of a sheet to actuate the sheet feed driving motor 140. Rotation of the sheet feed driving motor 140 causes the kick roller 118 and the separating roller 119 to separate one sheet from the others. The kick roller 118 and the separating roller 119 then feed the sheet to the conveying guide 128 between the separating roller 119 and the register roller 125. The sheet sensor 124 (referred to as the sensor 124 below) then detects the leading end of the sheet. In response to a signal indicating the sheet leading end, the timer T1 is actuated. After a predetermined time, the motor 140 is stopped.

As shown in FIG. 11(*a*), the sensor 124 detects the sheet leading end to actuate the timer T1. Then, as shown in FIG. 11(*b*), the sheet leading end abuts against the register roller 125 to bend and loop the sheet. Then, a time set in the timer T1 expires and the motor 140 is stopped.

Then, the control section of the image reading device A provides a sheet feed instructing signal to re-actuate and rotate the sheet feed driving motor 140 backward. At the same time, the sheet feed instructing signal actuates the timer T2, which allows the registration loop to be eliminated. The sheet is linearly supported and conveyed between the separating roller 119 and the register roller 125 as shown in FIG. 11(*c*).

As shown in FIG. 11(*d*), before the sheet trailing end leaves the separating roller 119, the sheet overlap sensing device 123 detects overlapping sheets. The sensor 124 detects the trailing end of the sheet being fed in this manner. Before and after the detection of the sheet trailing end, the lead sensor 126 detects the leading end of the sheet. The feeding roller 127 feeds the sheet to the platen 112.

The sheet the leading end of which has been sensed by the lead sensor 126 reaches the platen 112. Then, the optical mechanism 114 and the photoelectric converting element 113 execute a reading process on the sheet to provide an electric signal. After the reading process, the conveying roller 129 and the sheet discharging roller 130 discharge the sheet to the sheet discharging stacker 116. The sheet discharge sensor 145 detects that the sheet has been discharged.

In this case, the sheet overlap sensing device 123 is composed of an ultrasonic sensor and placed in a path from the separating roller 119 (sheet feeding device) to the register roller 125. The transmitting element 6*a* and receiving element 6*b* of the ultrasonic sensor determine whether or not the sheet overlapping detection functions correctly, in accordance with the failure determining procedure described in FIG. 6.

The disclosure of Japanese Patent Application No. 2004-170396, filed on Jun. 8, 2004, is incorporated in the application.

While the invention has been explained with reference to the specific embodiments of the invention, the explanation is illustrative and the invention is limited only by the appended claims.

What is claimed is:

1. A sheet feeding device comprising:

a stacker for placing sheets;

a sheet feeding device for separating and feeding the sheets on the stacker;

a sheet overlap sensing device disposed in a sheet conveying path at a downstream side of the sheet feeding device for detecting overlapping sheets, said sheet overlap sensing device having a transmitting element and a receiving element arranged in the sheet conveying path on opposite sides so that the sheet passes in between;

a sheet sensing device for detecting the sheet in the sheet overlap sensing device; and an error determining device for determining that the sheet overlap sensing device is operating abnormally according to output signals from the receiving element and a detection signal from the sheet sensing device.

2. A sheet feeding device according to claim 1, wherein said error determining device includes a comparing device for comparing the output signal from the receiving element with a reference value, and determines that the sheet overlap sensing device detects the overlapping sheets erroneously when the output signal from the receiving element is smaller than the reference value and the sheet sensing device detects no sheet while the transmitting element is active, or when the output signal from the receiving element is larger than the reference value while the transmitting element is inactive.

3. A sheet feeding device according to claim 2, wherein said transmitting element includes a wave transmitting element for transmitting an ultrasonic wave, and said receiving element includes a wave receiving element for receiving the ultrasonic wave.

4. A sheet feeding device according to claim 1, further comprising a sheet conveying device having a roller and a belt in the sheet conveying path for conveying the sheet, said sheet conveying device having a control device for controlling the sheet conveying device to convey the sheet when the error determining device determines that the sheet overlap sensing device operates abnormally.

5. A sheet feeding device comprising:

a sheet conveying path for conveying a sheet to a predetermined position;

a sheet overlap sensing device disposed in the sheet conveying path for detecting overlapping sheets, and having a transmitting element for generating an ultrasonic wave with a predetermined frequency and a receiving element for receiving the ultrasonic wave;

a sheet sensing device for detecting the sheet in the sheet overlap sensing device; and an error determining device for determining that the sheet overlap sensing device is operating abnormally, said error determining device determining that the sheet overlap sensing device is operating abnormally when the sheet sensing device detects no sheet and the ultrasonic wave received by the receiving element is attenuated by a value smaller than a predetermined value relative to the ultrasonic wave transmitted from the transmitting element; when the transmitting element is inactive and an output signal from the receiving element exceeds a predetermined level; or based on an output signal from the receiving element while the transmitted element is active and the output signal from the receiving element while the transmitted element is not active.

6. A sheet feeding device according to claim 5, wherein said error determining device determines that the sheet overlap sensing device is operating abnormally when the sheet sensing device detects no sheet.

* * * * *